US009790908B2

(12) United States Patent
Nagasaki et al.

(10) Patent No.: US 9,790,908 B2
(45) Date of Patent: Oct. 17, 2017

(54) CONTROL DEVICE FOR COMMON RAIL FUEL INJECTION DEVICE

(71) Applicant: ISUZU MOTORS LIMITED, Tokyo (JP)

(72) Inventors: Takahiro Nagasaki, Fujisawa (JP); Kazuyoshi Narita, Yokohama (JP); Kenta Suzuki, Atsugi (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 14/894,700

(22) PCT Filed: May 29, 2014

(86) PCT No.: PCT/JP2014/064302
§ 371 (c)(1),
(2) Date: Nov. 30, 2015

(87) PCT Pub. No.: WO2014/208264
PCT Pub. Date: Dec. 31, 2014

(65) Prior Publication Data

US 2016/0123291 A1 May 5, 2016

(30) Foreign Application Priority Data

Jun. 28, 2013 (JP) ..... 2013-136360

(51) Int. Cl.
*F02M 63/02* (2006.01)
*F02D 41/38* (2006.01)
(Continued)

(52) U.S. Cl.
CPC ..... *F02M 63/0285* (2013.01); *F02D 41/3845* (2013.01); *F02D 41/3863* (2013.01);
(Continued)

(58) Field of Classification Search
CPC ..... F02M 63/0285; F02M 51/061; F02M 59/366; F02M 63/0225; F02D 41/3845; F02D 41/3863; F02D 41/266
See application file for complete search history.

(56) References Cited

U.S. PATENT DOCUMENTS 5,642,716 A * 7/1997 Ricco ..... F02D 41/3809 123/447
6,918,376 B2 * 7/2005 Oono ..... F02D 41/042 123/458
(Continued)

FOREIGN PATENT DOCUMENTS

JP 2003-322067 11/2003

OTHER PUBLICATIONS

PCT International Preliminary Report on Patentability dated Dec. 29, 2015 in corresponding International Patent Application No. PCT/JP2014/064302.
(Continued)

*Primary Examiner* — Joseph Dallo
*Assistant Examiner* — Kurt Liethen
(74) *Attorney, Agent, or Firm* — Staas & Halsey LLP

(57) ABSTRACT

A common rail fuel injection device includes first and second flow rate regulating valves for regulating a delivery volume of a pressurized fuel feed pump that feeds pressurized fuel to a common rail, a pressure reducing valve for reducing a common rail pressure, and a control device. The control device for the common rail fuel injection device includes a first drive controlling unit that controls a first electromagnetic driving unit for the second flow rate regulating valve and a second electromagnetic driving unit for the pressure reducing valve, and a second drive controlling unit that controls a third electromagnetic driving unit for the first flow rate regulating valve. The first drive controlling unit prohibits a drive instruction from being sent to the
(Continued)

second flow rate regulating valve when the first drive controlling unit sends a drive instruction to the pressure reducing valve.

6 Claims, 3 Drawing Sheets

(51) Int. Cl.
*F02M 59/36* (2006.01)
*F02M 51/06* (2006.01)
*F02D 41/26* (2006.01)

(52) U.S. Cl.
CPC ..... *F02M 51/061* (2013.01); *F02M 59/366* (2013.01); *F02M 63/0225* (2013.01); *F02D 41/266* (2013.01)

(56) References Cited

U.S. PATENT DOCUMENTS 7,182,067 B2 * 2/2007 Ricco ..... F02D 41/3845 123/300
7,263,972 B2 * 9/2007 Tokuda ..... F02D 33/006 123/431

OTHER PUBLICATIONS

Espacenet Abstract, Publication No. JP 2003-322067, Published Nov. 14, 2003.
International Search Report dated Jul. 8, 2014 in International Patent Application No. PCT/JP2014/064302.

* cited by examiner

CONTROL DEVICE FOR COMMON RAIL FUEL INJECTION DEVICE

CROSS-REFERENCE TO RELATED APPLICATIONS

This application is a U.S. National Stage Application, which claims the benefit under 35 U.S.C. §371 of PCT International Patent Application No. PCT/JP2014/064302, filed May 29, 2014, which claims the foreign priority benefit under 35 U.S.C. §119 of Japanese Patent Application No. 2013-136360, filed Jun. 28, 2013, the contents of which are incorporated herein by reference.

TECHNICAL FIELD

The present invention relates to a control device for a common rail fuel injection device, and particularly to a technology for controlling a flow rate regulating valve, which is configured to regulate an amount of fuel delivered by a pressurized fuel feed pump, and controlling a pressure reducing valve, which is configured to reduce a pressure in a common rail.

BACKGROUND ART

A general common rail fuel injection device includes a pressurized fuel feed pump to feed a pressurized fuel to a common rail from a fuel tank, and a pressure reducing valve to reduce a pressure in the common rail (hereinafter, referred to as "common rail pressure"). The pressurized fuel feed pump is equipped with a plurality of flow rate regulating valves to regulate an amount of pressurized fuel to be delivered from the pump.

Each of the flow rate regulating valves and the pressure reducing valve has an electromagnetic driving unit that includes a solenoid. In order to control these electromagnetic driving units, an electronic control unit (hereinafter, referred to as "ECU") needs to have drive circuits. However, if the flow rate regulating valves and the pressure reducing valve have the drive circuits independently or separately, the entire drive circuit configuration becomes large, and an entire amount of heat emitted from the ECU may increase due to the increased number of the circuits.

To cope with these concerns, the electromagnetic driving units for the flow rate regulating valves and the pressure reducing valve may be controlled by a common drive circuit (see, for example, Patent Literature 1).

LISTING OF REFERENCES

PATENT LITERATURE 1: Japanese Patent Application Laid-Open Publication (Kokai) No. 2003-322067

One exemplary configuration for sharing a drive circuit, out of a plurality of drive circuits, by a plurality of elements is shown in FIG. 4. An electromagnetic driving unit 61 for a first flow rate regulating valve (PCV1) and an electromagnetic driving unit 63 for a pressure reducing valve (RPR) are commonly controlled by a first drive circuit 51 from an electronic control unit ("ECU") 50, and an electromagnetic driving unit 62 for a second flow rate regulating valve (PCV2) is controlled by a second drive circuit 52 of the ECU 50.

With such circuit configuration, however, rated currents are not supplied to the electromagnetic driving units 61 and 63 when the first flow rate regulating valve (PCV1) and the pressure reducing valve (RPR) are driven at the same time, as shown in FIG. 5. Then, a problem arises, i.e., expected operations may not be carried out. As a result, the common rail pressure may not be regulated to a desired pressure, and an engine may be damaged and broken.

An object of the present invention is to provide a control device for a common rail fuel injection device, which avoids simultaneous activation of the pressurized fuel feed pump and the pressure reducing valve and enables proper regulations to the common rail pressure.

SUMMARY OF THE INVENTION

Solution to Overcome the Problems

In order to achieve the above-mentioned object, the present invention provides a control device for a common rail fuel injection device. The common rail fuel injection device includes a first flow rate regulating valve and a second flow rate regulating valve configured to regulate a delivery volume of fuel from a pressurized fuel feed pump that feeds pressurized fuel to a common rail, and also includes a pressure reducing valve configured to reduce a pressure of the common rail. The control device for the common rail fuel injection device includes a first drive controlling unit configured to control an electromagnetic driving unit for the second flow rate regulating valve and an electromagnetic driving unit for the pressure reducing valve, and a second drive controlling unit configured to control an electromagnetic driving unit for the first flow rate regulating valve. When the first drive controlling unit sends a drive instruction (activation command) to the pressure reducing valve, the first drive controlling unit prohibits a drive instruction from being sent to the second flow rate regulating valve.

The second drive controlling unit may prohibit a drive instruction from being sent to the first flow rate regulating valve when the first drive controlling unit sends the drive instruction to the pressure reducing valve.

The first drive controlling unit may refrain from driving (activating) the pressure reducing valve until the second flow rate regulating valve finishes its movement, if the first drive controlling unit sends the drive instruction to the second flow rate regulating valve and also is required to drive the pressure reducing valve. The first drive controlling unit may send the drive instruction to the electromagnetic driving unit of the pressure reducing valve immediately after the pressurized fuel feed pump finishes its operation.

The present invention can provide a control device for a common rail fuel injection device, which avoids simultaneous driving (activation) of the pressurized fuel feed pump and the pressure reducing valve and enables proper regulations to the common rail pressure.

FIG. 1 schematically shows an entire configuration of a common rail fuel injection device according to an embodiment of the present invention.

DETAILED DESCRIPTION

Figure 1:
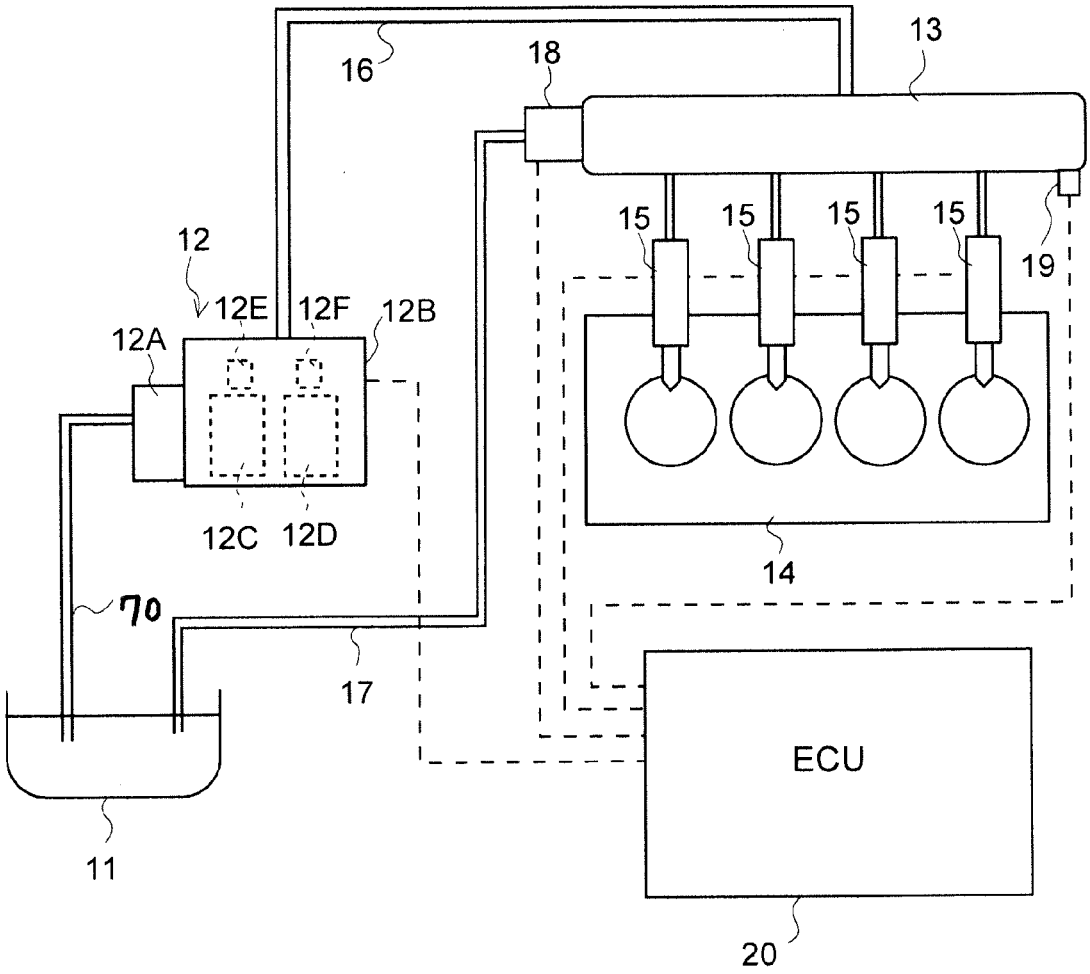

A control device for a common rail fuel injection device according to embodiments of the present invention will be described below with reference to the accompanying drawings. Same parts are assigned the same reference numeral, and assigned the same names and functions as well. Thus, the detailed description for the same parts will not be repeated.

As shown in FIG. 1, the common rail fuel injection device of this embodiment includes a fuel tank 11 for reserving a fuel, a pressurized fuel feed pump 12 for feeding a pressurized fuel, a common rail 13 for pressurizedly accumulating the fuel having a high pressure, a plurality of injectors 15 for directly injecting the fuel into associated cylinders of a diesel engine (hereinafter simply referred to as "engine") 14, and an ECU 20 or a control unit. It should be noted that the engine 14 is a four-cylinder engine in this embodiment, but the engine may be a single cylinder engine or a multiple-cylinder engine other than the four-cylinder engine.

The pressurized fuel feed pump 12 has a feed pump 12A to pump up the fuel from the fuel tank 11 through a fuel feed pipe 70 upon rotation of a pump drive shaft (not shown) activated by the drive power of the engine 14, and a pump main unit 12B having two cylinders 12C and 12D. In each of the cylinders 12C and 12D, a plunger (not shown) is disposed such that the plunger is driven by a cam (not shown) attached to the pump drive shaft and the plunger moves back and forth or reciprocally. As the plunger moves reciprocally, the fuel sucked into a pressurizing chamber (not shown) is pressurized.

In the pressurized fuel feed pump 12, there is formed a fuel passage (not shown) for introducing the fuel into the pressurizing chamber from the feed pump 12A. On the fuel passage, there are provided a first flow rate regulating valve 12E (hereinafter, referred to as "first PCV") configured to regulate an amount of fuel to be delivered, and a second flow rate regulating valve 12F (hereinafter, referred to as "second PCV") configured to regulate an amount of fuel to be delivered. The first PCV and the second PCV have electromagnetic driving units 31 and 32 (see FIG. 2), respectively. Each of the electromagnetic driving units has a solenoid (not shown).

The common rail 13 accumulates the high pressure fuel, which is supplied from the pressurized fuel feed pump 12 through the high pressure feed pipe 16. The injectors 15 are connected to the common rail 13 via the feed pipes, respectively. The high pressure fuel is always supplied to the injectors 15.

A pressure reducing valve 18 is attached to the common rail 13 for regulating the common rail pressure. The pressure reducing valve 18 has an electromagnetic driving unit 33 (see FIG. 2). The electromagnetic driving unit 33 has a solenoid (not shown). When the pressure reducing valve 18 opens, the high pressure fuel in the common rail 13 returns to the fuel tank 11 through an exit pipe 17, and the common rail pressure drops.

The ECU 20 carries out various control and processing such as fuel injection from the injectors 15. The ECU 20 has known CPU, ROM, RAM, input port, output port and other components. In order to perform the control and processing, the ECU 20 receives the output signals of the various sensors, such as a common rail pressure sensor 19, an engine rotation speed sensor (not shown), and an accelerator opening degree sensor (not shown), after the output signals undergoes the A/D conversion.

Figure 2:
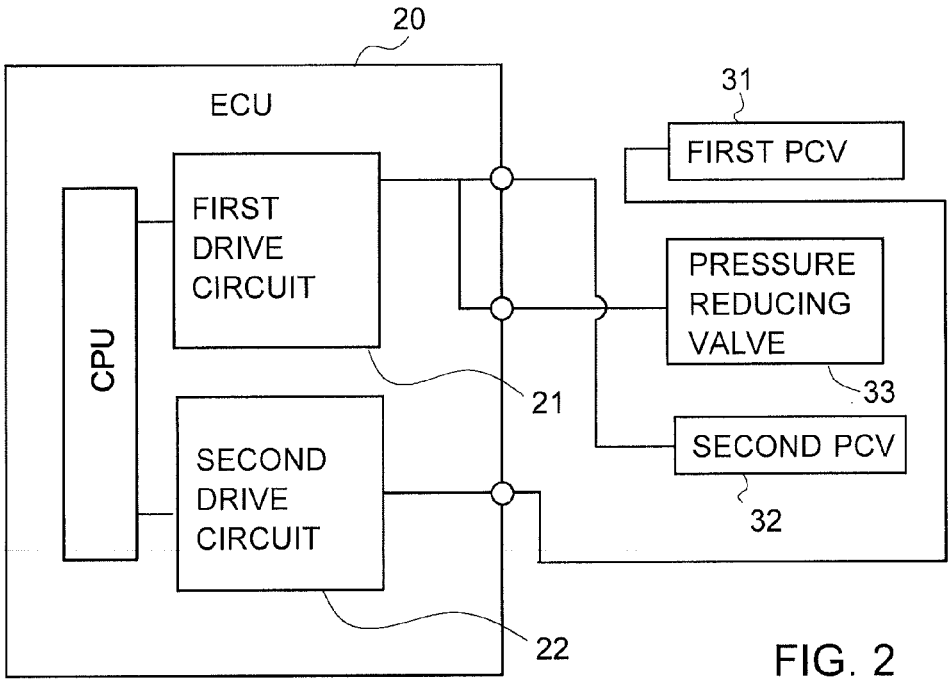
FIG. 2 is a schematic circuitry diagram showing an ECU and electromagnetic driving units according to an embodiment of the present invention.

As shown in FIG. 2, the ECU 20 also has a first drive circuit 21 and a second drive circuit 22. The first drive circuit 21 is configured to apply a pulsing current to the electromagnetic driving unit 32 of the second PCV and the electromagnetic driving unit 33 of the pressure reducing valve 18 to drive the electromagnetic driving units 32 and 33. The second drive circuit 22 is configured to apply a pulsing current to the electromagnetic driving unit 31 of the first PCV to drive the electromagnetic driving unit 31. An amount of the current to be applied from each of the first drive circuit 21 and the second drive circuit 22 to the electromagnetic driving unit 31, 32, 33 is feedback controlled such that a target fuel pressure, which is calculated on the basis of the running condition of the engine 14, coincides with the common rail pressure detected by the common rail pressure sensor 19.

Figure 3:
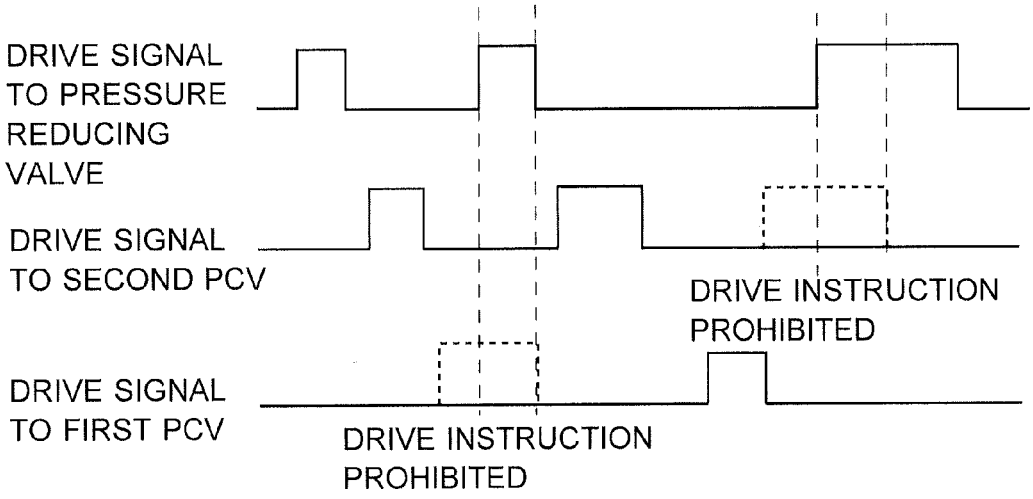
FIG. 3 is a timing chart showing drive instruction signals issued from the ECU according to an embodiment of the present invention.
Figure 4:
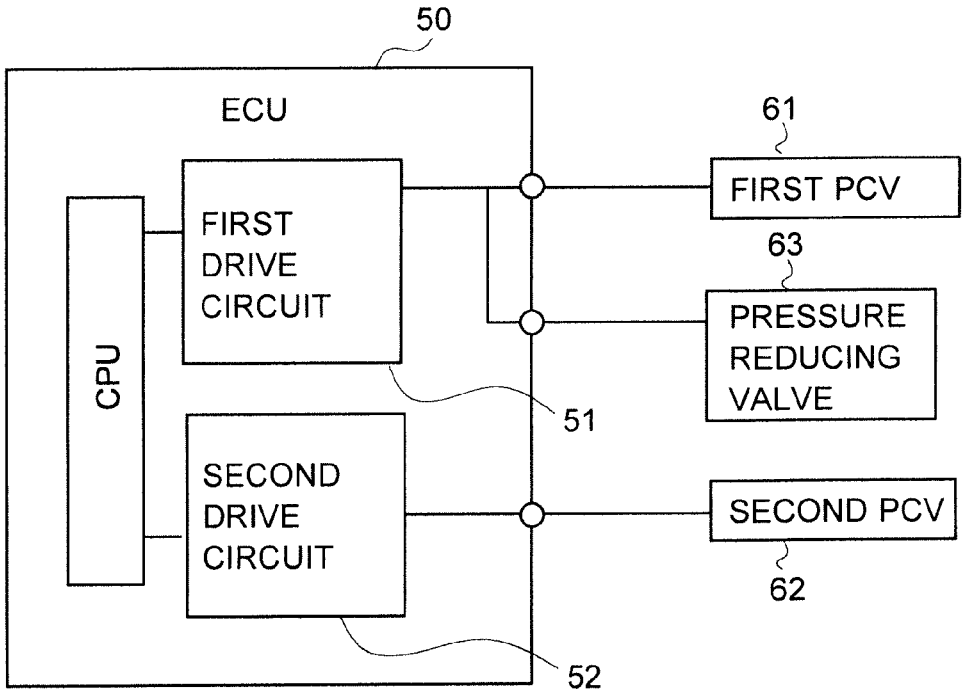
PRIOR ART FIG. 4
FIG. 4 is a schematic circuitry diagram showing an ECU and electromagnetic driving units of a conventional common rail fuel injection device.
Figure 5:
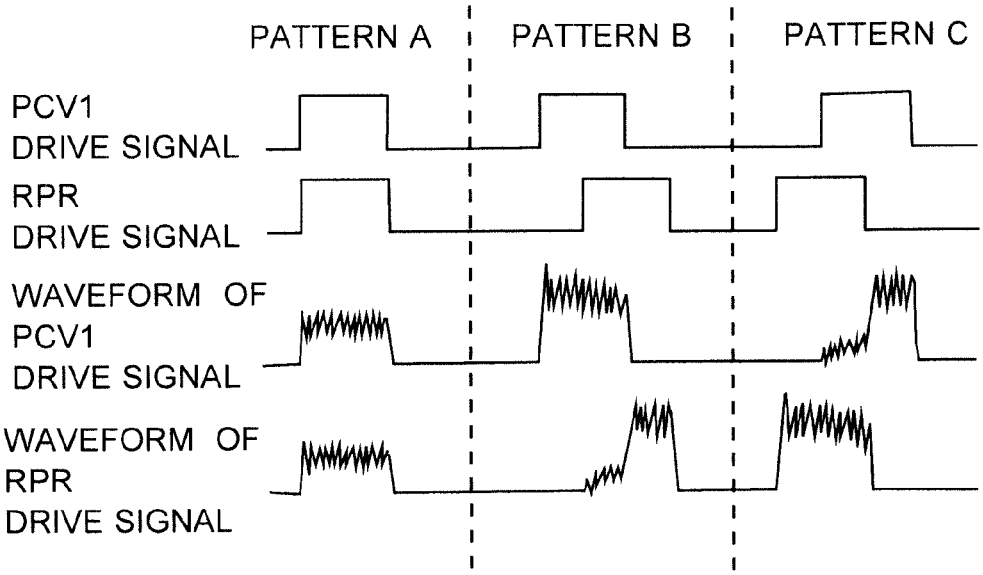
PRIOR ART FIG. 5
FIG. 5 is a timing chart showing drive instruction signals issued from the ECU of the conventional common rail fuel injection device.

In this embodiment, the ECU 20 has a prohibition function, i.e., when the ECU 20 sends the activation command (drive instruction) to the electromagnetic driving unit 33 of the pressure reducing valve 18 from the first drive circuit 21, the ECU 20 prohibits the sending of the activation command to the electromagnetic driving unit 32 of the second PCV. In other words, if the target activation timing of the second PCV, which is calculated on the basis of the detection values of the engine rotation speed sensor and the accelerator opening degree sensor, overlaps the target activation timing of the pressure reducing valve 18, the activation of the pressure reducing valve 18 is prioritized, and the activation of the second PCV is prohibited, as shown in FIG. 3. This ensures that the simultaneous activation of the second PCV and the pressure reducing valve 18 is avoided even if the single drive circuit is shared (mutually used) by the second PCV and the pressure reducing valve 18.

It should be noted that the ECU (or the control device) may also have a function of prohibiting the sending of the activation command to the electromagnetic driving unit 31 of the first PCV from the second drive circuit 22 when the first drive circuit 21 sends the activation command to the electromagnetic driving unit 33 of the pressure reducing valve 18.

It should be noted that if the pressure reducing valve 18 should be activated while the first drive circuit 21 is sending the activation command to the electromagnetic driving unit 32 of the second PCV, the ECU (or the control device) may refrain from sending the activation command to the pressure reducing valve 18 until the pressurized fuel feed pump 12 finishes its operation. The ECU (or the control device) may send the activation command to the electromagnetic driving unit 33 of the pressure reducing valve 18 immediately after the pressurized fuel feed pump 12 finishes its operation.

The operations and advantages of the control device of the common rail fuel injection device according to this embodiment will now be described.

In the control device of this embodiment, the first drive circuit 21 controls the activation of the electromagnetic driving unit 32 of the second PCV and the activation of the electromagnetic driving unit 33 of the pressure reducing valve 18, and the second drive circuit 22 controls the activation of the electromagnetic driving unit 31 of the first PCV. When the first drive circuit 21 sends the activation command (drive instruction) to the electromagnetic driving unit 33 of the pressure reducing valve 18, the control device prohibits the sending of the activation command to the electromagnetic driving unit 32 of the second PCV.

Therefore, the control device for the common rail fuel injection device of this embodiment can reliably avoid the simultaneous activation of the pressurized fuel feed pump 12 and the pressure reducing valve 18. Also, it is possible to properly control the common rail pressure, and reliably prevent damage to the engine 14.

It should be noted that the present invention is not limited to the above-described embodiment. Various changes and modifications may be made to the above-described embodiment without departing from the scope and spirit of the present invention.

For example, the pressurized fuel feed pump 12 is not limited to the pump having the two flow rate regulating valves. The pump 12 may have three or more flow rate regulating valves. The engine 14 is not limited to the diesel engine. The present invention may be applied to other engines such as a gasoline engine.

What is claimed is:

1. A control device for a common rail fuel injection device, comprising:

a feed pump that pumps fuel from a fuel tank, pressurizes the fuel and feeds the pressurized fuel to a common rail, wherein the feed pump includes a first flow rate regulating valve and a second flow rate regulating valve configured to regulate a volume of the pressurized fuel fed from the feed pump to the common rail;

a pressure reducing valve configured to reduce a pressure of the common rail;

a first drive controller configured to control a first electromagnetic activator of the second flow rate regulating valve and a second electromagnetic activator of the pressure reducing valve; and a second drive controller configured to control a third electromagnetic activator of the first flow rate regulating valve, wherein the first drive controller is configured to prohibit an activation instruction from being sent to the first electromagnetic activator of the second flow rate regulating valve when the first drive controller sends an activation instruction to the second electromagnetic activator of the pressure reducing valve.

2. The control device for a common rail fuel injection device according to claim 1, wherein the second drive controller prohibits an activation instruction from being sent to the third electromagnetic activator of the first flow rate regulating valve when the first drive controller sends the activation instruction to the second electromagnetic activator of the pressure reducing valve.

3. The control device for a common rail fuel injection device according to claim 1, wherein the first drive controller is configured to refrain from activating the second electromagnetic activator of the pressure reducing valve until the activation of the first electromagnetic activator of the second flow rate regulating valve is completed, if the first drive controller sends the activation instruction to the first electromagnetic activator of the second flow rate regulating valve and also is required to activate the second electromagnetic activator of the pressure reducing valve.

4. The control device for a common rail fuel injection device according to claim 2, wherein the first drive controller is configured to refrain from activating the second electromagnetic activator of the pressure reducing valve until the activation of the first electromagnetic activator of the second flow rate regulating valve is completed, if the first drive controller sends the activation instruction to the first electromagnetic activator of the second flow rate regulating valve and also is required to activate the second electromagnetic activator of the pressure reducing valve.

5. A control device for a common rail fuel injection device, the common rail fuel injection device including a first flow rate regulating valve and a second flow rate regulating valve configured to regulate a delivery volume of fuel from a pressurized fuel feed pump that feeds pressurized fuel to a common rail, and also including a pressure reducing valve configured to reduce a pressure of the common rail, said control device comprising:

a first drive controlling unit configured to control a first electromagnetic driving unit of the second flow rate regulating valve and a second electromagnetic driving unit of the pressure reducing valve; and a second drive controlling unit configured to control a third electromagnetic driving unit of the first flow rate regulating valve, the first drive controlling unit being configured to prohibit a drive instruction from being sent to the second flow rate regulating valve when the first drive controlling unit sends a drive instruction to the pressure reducing valve, wherein the first drive controlling unit is configured to refrain from driving the pressure reducing valve until the second flow rate regulating valve finishes its movement, if the first drive controlling unit sends the drive instruction to the second flow rate regulating valve and also is required to drive the pressure reducing valve.

6. A control device for a common rail fuel injection device, the common rail fuel injection device including a first flow rate regulating valve and a second flow rate regulating valve configured to regulate a delivery volume of fuel from a pressurized fuel feed pump that feeds pressurized fuel to a common rail, and also including a pressure reducing valve configured to reduce a pressure of the common rail, said control device comprising:

a first drive controlling unit configured to control a first electromagnetic driving unit of the second flow rate regulating valve and a second electromagnetic driving unit of the pressure reducing valve; and a second drive controlling unit configured to control a third electromagnetic driving unit of the first flow rate regulating valve, the first drive controlling unit being configured to prohibit a drive instruction from being sent to the second flow rate regulating valve when the first drive controlling unit sends a drive instruction to the pressure reducing valve, wherein the second drive controlling unit prohibits a drive instruction from being sent to the first flow rate regulating valve when the first drive controlling unit sends the drive instruction to the pressure reducing valve, and wherein the first drive controlling unit is configured to refrain from driving the pressure reducing valve until the second flow rate regulating valve finishes its movement, if the first drive controlling unit sends the drive instruction to the second flow rate regulating valve and also is required to drive the pressure reducing valve.

* * * * *